United States Patent [19]

Dziedzic et al.

[11] 4,083,400

[45] Apr. 11, 1978

[54] HEAT RECUPERATIVE APPARATUS INCORPORATING A CELLULAR CERAMIC CORE

[75] Inventors: Chester John Dziedzic, Dushore; Joseph Jerome Cleveland, Wysox; Ray Lewis Newman, Towanda, all of Pa.

[73] Assignee: GTE Sylvania, Incorporated, Stamford, Conn.

[21] Appl. No.: 686,040

[22] Filed: May 13, 1976

[51] Int. Cl.[2] ..... F28F 3/00

[52] U.S. Cl. ..... 165/165; 165/10

[58] Field of Search ..... 165/165, 166, 10

[56] References Cited

U.S. PATENT DOCUMENTS

| | | | |
|---|---|---|---|
| 2,821,369 | 1/1958 | Hilliard | 165/165 |
| 2,887,303 | 5/1959 | Reys | 165/165 |
| 3,885,942 | 5/1975 | Moore | 165/166 |
| 3,889,744 | 6/1975 | Hill et al. | 165/165 X |
| 3,926,251 | 12/1975 | Pei | 165/165 |
| 3,948,317 | 4/1976 | Moore | 165/165 |

*Primary Examiner*—Charles J. Myhre
*Assistant Examiner*—Ira S. Lazarus
*Attorney, Agent, or Firm*—John C. Fox

[57] ABSTRACT

High cell density (125 Cells/inch) cross-flow ceramic recuperators having high efficiencies are utilized for industrial waste heat recovery in an apparatus in which a ceramic recuperator core is surrounded by a metallic housing adapted for coupling to the metallic fittings of existing furnaces, ovens and preheaters. Insulating and sealing layers between the core and housing minimize heat loss through the housing and prevent leakage of the heat transfer fluids past the core.

11 Claims, 7 Drawing Figures

HEAT RECUPERATIVE APPARATUS INCORPORATING A CELLULAR CERAMIC CORE

BACKGROUND OF THE INVENTION

This invention relates to industrial heat recuperators, and more particularly relates to a heat recuperative apparatus employing a ceramic cross-flow heat recuperator for use on furnaces, ovens and preheaters.

Recent concern about energy conservation and rising fuel costs has caused renewed interest in industrial recuperators to recover waste heat losses and preheat incoming combustion air to increase the efficiency of furnaces, ovens, and preheaters.

While such recuperators are usually constructed from metal parts, the ceramic recuperator has several advantages over conventional metallic recuperators. For example, ceramics in general have high corrosion resistance, high mechanical strength at elevated temperatures, low thermal expansion coefficients (TEC'S) and good thermal shock resistance, and thus exhibit excellent endurance under thermal cycling; are light in weight (about ⅓ the weight of stainless steel); and are cost competitive with high temperature alloys.

Furthermore, ceramic recuperators are available in a variety of shapes, sizes, hydraulic diameters, (hydraulic diameter is a measure of cross-sectional area divided by wetted perimeter) and compositions. Because their TEC'S are typically lower than those of most metals and alloys, however, ceramic recuperators present a compatibility problem to the design engineer desiring to incorporate them into existing furnace, oven and preheater structures.

SUMMARY OF THE INVENTION

In accordance with the invention, a ceramic cross-flow recuperator core is incorporated into a metallic housing adapted for coupling to the metallic fittings of existing furnaces, ovens and preheaters. Insulating and resilient sealing layers between the core and housing minimize heat loss through the metallic housing and prevent leakage of heat transfer fluids such as exhaust flue gases and incoming combustion air, past the core.

In accordance with a preferred embodiment, a single unitary cross-flow recuperative structure is employed to form both the recuperator core and an insulating housing surrounding the core. This is achieved by sealing a portion of the outer cells contiguous to the metallic housing to promote gas passage through the central or core portion only of the structure.

In accordance with another preferred embodiment, the resilient seal is achieved by use of a resilient organic sealant material between the insulating housing and the metallic housing contiguous to the cool faces of the core.

In accordance with yet another preferred embodiment, the ceramic housing or core or both extend into and protrude beyond one opening of the metallic housing contiguous to one of the hot faces of the core, to form a mating surface for contact with the ceramic lining of a flue gas conduit or opening, to form a gas-tight seal for communication between the flue and the hot face of the core.

The recuperative apparatus is useful to preheat incoming heating or combusion air and/or fuel and thus increase the efficiency of existing furnaces, ovens and preheaters of varying types and sizes.

DETAILED DESCRIPTION OF THE INVENTION

For a better understanding of the present invention, together with other and further objects, advantages and capabilities thereof, reference is made to the following disclosure and appended claims in connection with the above-described Drawing.

Figure 1:
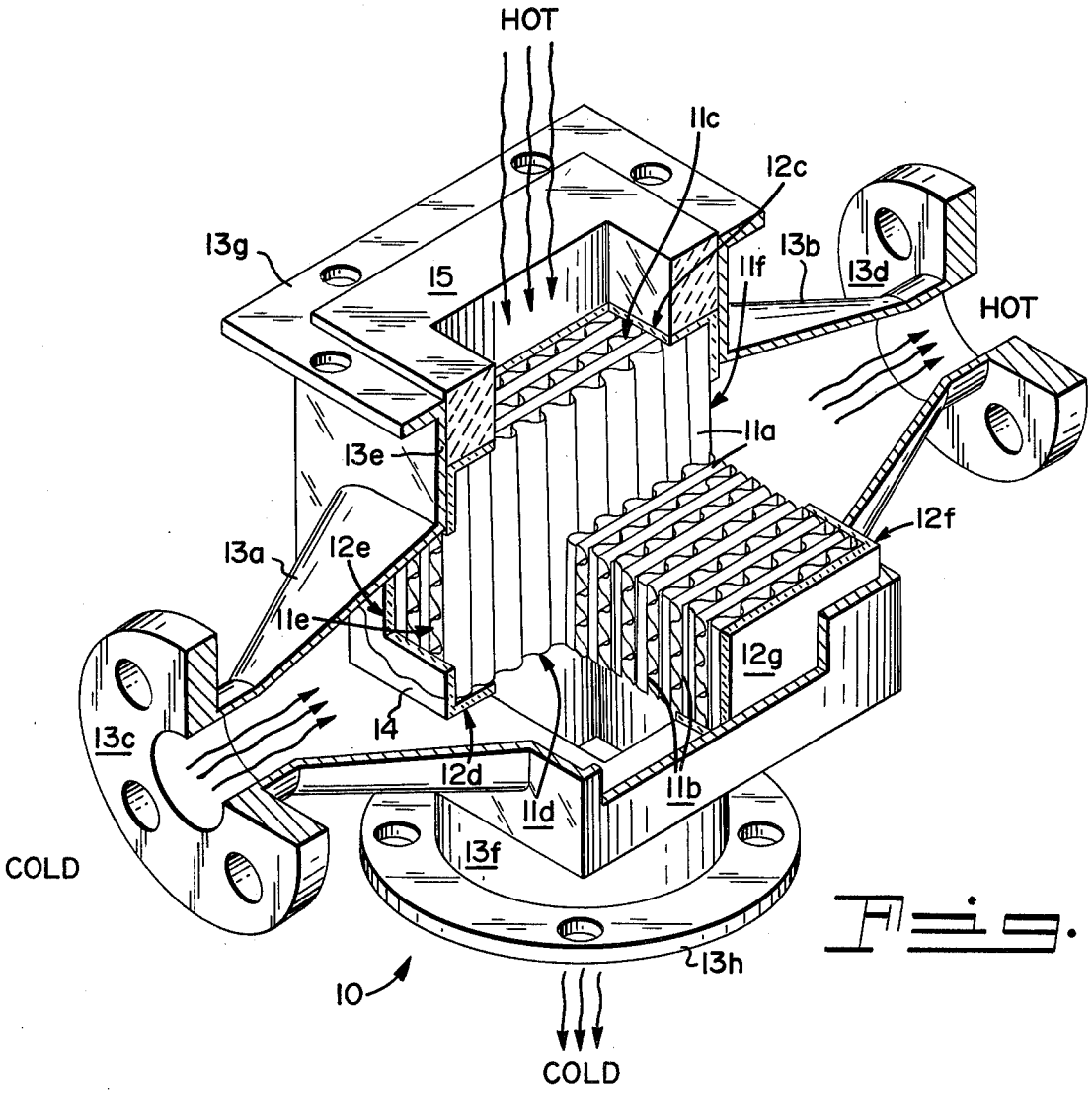
FIG. 1 is a perspective view, partly cut away, of one embodiment of the heat recuperative apparatus of the invention, wherein the recuperator core and insulative housing are of a unitary ceramic structure of alternating corrugated and flat layers.

Referring now to FIG. 1 of the Drawing, there is shown in perspective, partly cut away, one embodiment of the recuperative apparatus 10 of the invention, comprising a central portion 11 of a ceramic cross-flow recuperator structure, made up of alternating corrugated and flat layers 11*a* and 11*b*. A technique for fabricating such structures having high cell densities by tape casting thin layers of ceramic slurry compositions is described in allowed patent application Ser. No. 455,193, filed 3/27/74, and assigned to the present assignee. The following table lists some exemplary ceramic materials suitable for the fabrication of recuperators by the tape casting technique, together with average thermal expansion coefficient (TEC) values over the range room temperature-800° C in inches/inch° C and maximum use temperatures (MUT) in ° F.

TABLE I

| MATERIAL | (INCHES/INCH/° C) TEC | MUT. |
|---|---|---|
| Mullite | 4 to 5 × $10^{-6}$ | 3400° F |
| Zircon | 4 to 5 × $10^{-6}$ | 2000° F |
| Magnesium Aluminum Silicate | 1 × $10^{-6}$ | 2000° F |
| Porcelain | 4 × $10^{-6}$ | 2000° F |
| Aluminum Oxide | 8 × $10^{-6}$ | 2500° F |

Figure 2:
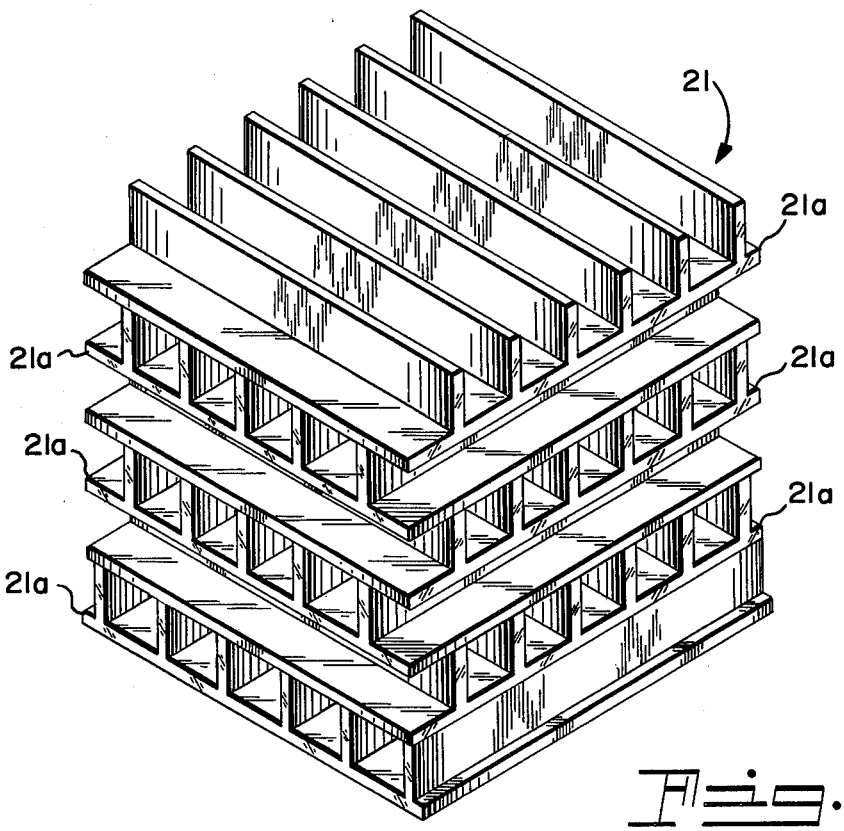
FIG. 2 is a perspective view of an alternate recuperator core structure of stacked rib layers.

FIG. 2 shows an alternate recuperator structure 21 comprised of stacked layers 21*a* of ribbed sheets which may be formed for example, by extrusion.

In FIG. 1, in accordance with a preferred embodiment, thin layers 12*c*, 12*d*, 12*e* and 12*f* of a ceramic material 12, preferably of a compressible structure such as mullite paper about ⅛ inch thick, and having openings or windows in their central portions, are cemented to the two pairs of opposing faces 11*c*, 11*d*, 11*e*, and 11*f* defining cell openings. By this expedient, the central or core portion of the structure is surrounded by sealed cells containing dead air. Thus, a highly efficient insulating housing is provided with a minimal use of material and without the need for fabrication of complex parts. In addition, the compressible mullite paper 12 acts as a high temperature gasket material during later assembly into the metallic housing 13. For this reason, it may be desired to also cement layers **12*g* and 12*h*** of the paper to the remaining blank faces of the recuperator structure. Any compatible ceramic cement may be used, such as mullite or aluminum oxide powder and binding agent mixed with water.

Figure 7:
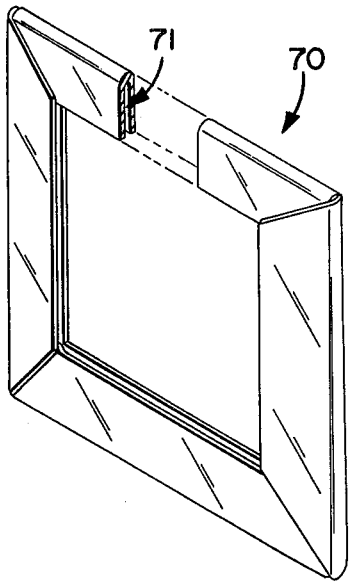
FIG. 7 is a perspective view of a metallic sealing means for use in the invention.

Because of the large differences in thermal expansion coefficients between most ceramics and metals, a resilient settable plastic sealant material 14 is used to maintain a gas-tight seal between the ceramic paper 12 and the metallic housing 13. This material should be capable of withstanding shock without permanent deformation or rupture. For minimal useage of material, it is preferred to form beads along the edges of the cold faces **11*d* and 11*e* of the recuperator structure prior to insertion into the metallic housing 13, leaving hot faces 11*c* and 11*f*** unsealed. This placement has the additional advantage that the bead is subjected to only moderate temperatures, enabling use of materials such as silicone rubber, having a maximum use temperature of about 550° F.

Where use temperatures above 550° F are required, the silicone rubber seal may be replaced by a flexible compressible metal seal 70, such as the one shown in FIG. 7 having a space 71 between front and back faces to allow for compression of the seal. This could be fabricated from stainless steel about 0.012 inches thick.

The metallic housing 13 may be formed of a single casting, or of machined and welded parts, and is preferably of a corrosion resistant metal such as stainless steel in corrosive applications and above 600° F housing skin temperature. Tapered conduit portions **13*a* and 13*b* terminate in flanged portions 13*c* and 13*d* for connection into the incoming heating or combustion air or fuel line. Sidewall portions 13*e* and 13*f* define openings terminating in flanged portions 13*g* and 13*h*** for connection into the exhaust heat or flue gas outlet. The recuperator core is thus heated by the passage of hot exhaust gases through it, and incoming cold air or fuel is in turn preheated as it passes through the core in the transverse direction.

Sidewall portion **13*e* defines an opening just large enough to admit the recuperator structure after expansion of the metallic housing by moderate heating. Thus, upon cooling, a force fit is achieved. After placement of the structure in the housing, a ceramic insert 15 preferably cast in situ, is positioned atop the structure to protrude beyond the opening and contact the mating surface of a ceramic lining of an exhaust or flue gas opening or conduit. Flange 13*g*** connects to the flue gas conduit or furance housing and maintains the ceramic members in intimate contact.

Suitable materials for formation of the insert 15 are castable compositions of the materials which are shown in Table II, along with their average thermal expansion coefficients (TEC'S) in inches/inch/° C measured over the range room temperature-800° C, and maximum use temperatures (MUT) in ° F.

TABLE II

| MATERIAL | TEC | MUT |
|---|---|---|
| Aluminum oxide | $8 \times 10^{-6}$ | 3000° F |
| Zircon | 4 to $5 \times 10^{-6}$ | 3000° F |
| Mullite | 4 to $5 \times 10^{-6}$ | 3300° F |
| Zirconia | 9 to $10 \times 10^{-6}$ | 4000° F |

Figure 3:
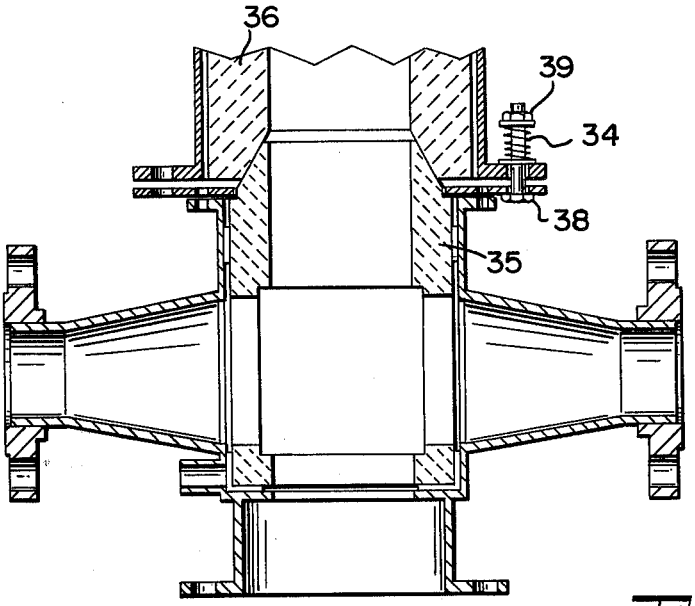
FIG. 3 is a front elevational view, partly in section, of another embodiment of the apparatus of the invention, wherein the insulative housing extends through the metallic housing and forms a male portion for connection to a mating female portion of a flue.

Referring now to FIG. 3 there is shown a front elevational view, partly in section, of another embodiment of the apparatus of the invention, wherein ceramic insert 35 forms a male connecting portion for insertion into a mating female portion of a ceramic flue lining 36. The compositions of the male and female portions may be chosen so that the TEC of the male portion is substantially larger than (e.g., twice as large) that of the female portion. This arrangement provides an adequate gas seal under severe conditions such as continuous cycling between hot and cold temperatures, or excessive flue gas back pressure.

Connecting bolt 38 and nut 39 are provided with helical spring 34, which acts as a bias element permitting expansion and contraction of the male insert 35 during thermal cycling, while maintaining intimate contact between the male and female portions 35 and 36.

Figure 4:
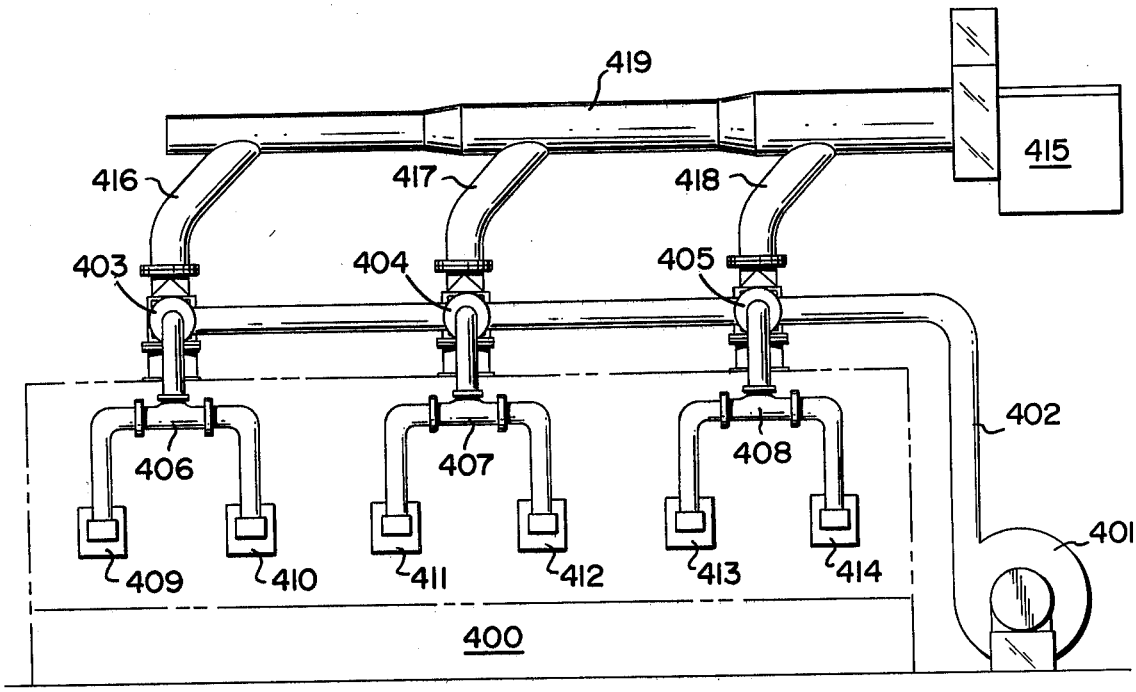
FIG. 4 is a side elevational view of a heat recuperative system employing a series of recuperators of the invention on a tunnel-type furnace.

Referring now to FIG. 4, there is shown in side elevational view an arrangement wherein a series of three recuperators of the invention are installed on a tunnel kiln 400 employing six gas burners. Blower 401 supplies combustion air through conduit 402 to recuperators 403, 404 and 405, and thence the preheated air is delivered through conduits 406, 407 and 408 to gas burners 409, 410, 411, 412, 413 and 414. Flue gas combustion products are drawn by blower 415 through recuperators 403, 404 and 405, and thence through ducts 416, 417 and 418 to flue gas exhaust manifold 419.

Figure 5:
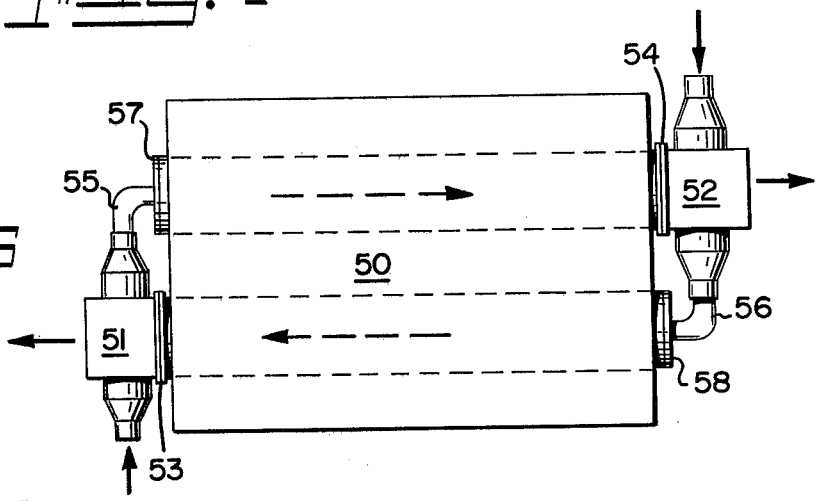
FIG. 5 is a schematic diagram of a heat recuperative system employing two recuperators of the invention on a two-burner horizontal radiant tube furnace.
Figure 6:
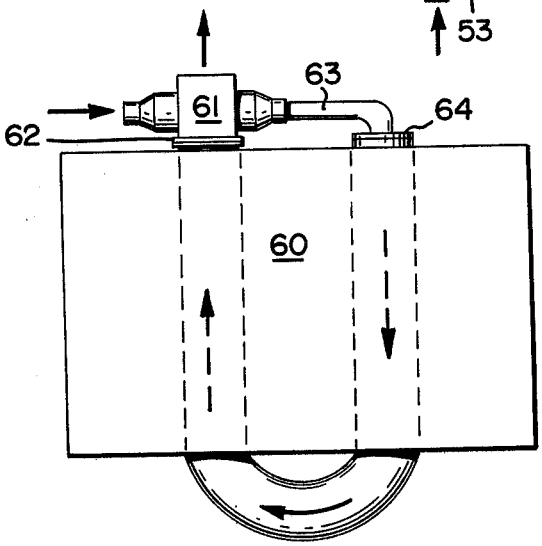
FIG. 6 is a schematic diagram of a similar system for a single-burner vertical "U" radiant tube furnace.

Referring now to FIG. 5, there is shown in schematic form an arrangement whereby recuperators 51 and 52 are installed on the exhaust ports 53 and 54 a two-burner horizontal radiant tube furnace 50. Preheated combustion air is supplied through conduits 55 and 56 to burner inlets 57 and 58. FIG. 6 shows a similar arrangement for a vertical "U" radiant tube furance 60 employing a single burner. Recuperator 61 is installed on the exhaust port 62 and preheated combustion air is supplied through conduit 63 to burner inlet 64.

While there has been shown and described what are at present considered the preferred embodiments of the invention, it will be obvious to those skilled in the art that various changes and modifications may be made therein without departing from the scope of the invention as defined by the appended claims.

What is claimed is:

1. A heat recuperative apparatus comprising:

(a) a core of a cross-flow ceramic recuperator, having first and second pairs of opposing faces defining cell openings for the passage of first and second heat transfer fluids, respectively, in directions transverse to one another, the first fluid transferring heat to the second fluid during passage through the cells, whereby each pair of faces has in operation a hot face and a cold face, the hot face of the first pair being the inlet face for the first fluid, and the hot face of the second pair being the outlet face for the second fluid, (b) a metallic housing surrounding the core, the housing defining openings communicating with the core cell openings, the housing openings adapted for coupling to external fluid conduits, (c) means for thermally insulating the core from the housing to promote transfer within the core between the fluids, and (d) means for maintaining a resilient seal between the insulating means and the housing to promote passage of the heat transfer fluids through the core cells.

2. The heat recuperative apparatus of claim 1 in which the means for insulating the core from the housing comprises a ceramic housing inside the metallic housing surrounding the core and in contact therewith, the ceramic housing defining openings to expose the opposing hot and cold core faces defining the cell openings.

3. The apparatus of claim 2 in which the ceramic core and ceramic housing comprise a unitary cross-flow recuperative structure and means for sealing a portion of the outer cells contiguous to the metallic housing, leaving the inner cells unsealed, whereby the inner cells comprise the recuperator core and the outer cells comprise the insulative housing.

4. The apparatus of claim 3 in which the means for sealing the outer portion of cells comprises thin layers of a ceramic material bonded to the outer portions of the faces defining the cell openings, thereby leaving unsealed the inner cells.

5. The apparatus of claim 4 in which the thin ceramic material comprises a compressible ceramic paper.

6. The apparatus of claim 1 in which the resilient sealing means comprises a resilient settable plastic organic sealant material between at least portions of the insulating means and the metallic housing contiguous to the cold faces of the recuperator core.

7. The apparatus of claim 6 in which the resilient sealing means comprises silicone rubber.

8. The heat recuperative apparatus of claim 2 in which the ceramic insulative housing includes a portion which extends into and protrudes beyond one of the openings in the metallic housing and forms a mating surface for contact with the mating surface of a ceramic lining of a metallic flue gas conduit, and in which the opening in the metallic housing is adapted for coupling to the flue gas conduit to maintain intimate contact between the ceramic portions.

9. The heat recuperative apparatus of claim 8 in which the extending and protruding portion of the ceramic insulative housing forms a male portion for insertion into a mating female portion of the ceramic flue gas lining.

10. The apparatus of claim 8 in which the extending and protruding portion of the ceramic housing is at least partly comprised of a composition different from that of the remainder of the housing.

11. The apparatus of claim 10 in which the ceramic male portion is chosen to have a thermal expansion coefficient greater than that of the ceramic female portion and the means for coupling the metallic conduit sections includes at least one bias element to permit the coupling to expand and contract while maintaining intimate contact between the male and female portions.

* * * * *